US008410030B2

(12) United States Patent
Ward et al.

(10) Patent No.: US 8,410,030 B2
(45) **Date of Patent: *Apr. 2, 2013**

(54) ALKALI METAL BORATE AND LUBRICATING COMPOSITIONS THEREOF

(75) Inventors: William C. Ward, Perry, OH (US); Richard A. Denis, Parma Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/461,105

(22) Filed: May 1, 2012

(65) Prior Publication Data

US 2012/0214716 A1 Aug. 23, 2012

Related U.S. Application Data

(62) Division of application No. 12/525,702, filed on Dec. 15, 2009, now Pat. No. 8,193,130.

(51) Int. Cl.
*C10M 173/02* (2006.01)

(52) U.S. Cl. ..... 508/158; 508/156

(58) Field of Classification Search ..... 508/156, 508/158

See application file for complete search history.

(56) References Cited

U.S. PATENT DOCUMENTS

| | | | | |
|---|---|---|---|---|
| 3,912,643 | A * | 10/1975 | Adams | 508/156 |
| 4,163,729 | A | 8/1979 | Adams | |
| 4,560,489 | A * | 12/1985 | Muir et al. | 508/158 |
| 5,877,129 | A * | 3/1999 | Yatsuzuka et al. | 508/156 |
| 6,632,781 | B2 | 10/2003 | Harrison et al. | |
| 6,737,387 | B2 | 5/2004 | Harrison et al. | |
| 8,193,130 | B2 * | 6/2012 | Ward et al. | 508/158 |
| 2002/0147115 | A1 | 10/2002 | Harrison | |
| 2003/0073587 | A1 | 4/2003 | Harrison et al. | |
| 2004/0087450 | A1 | 5/2004 | Boffa | |

FOREIGN PATENT DOCUMENTS

| | | |
|---|---|---|
| EP | 0718394 | 6/1996 |
| WO | 0063324 | 10/2000 |

OTHER PUBLICATIONS

Corresponding PCT Publication No. WO 2008/106345 A1, including PCT Search Report, dated Sep. 4, 2008.

* cited by examiner

*Primary Examiner* — Walter D Griffin
*Assistant Examiner* — Francis C Campanell
(74) *Attorney, Agent, or Firm* — Michael F. Esposito; David M. Shold

(57) ABSTRACT

The present invention relates to a lubricating composition containing an alkali metal borate. The invention further provides for a method of lubricating a device with grease or a metalworking fluid by employing the lubricating composition containing the alkali metal borate.

14 Claims, No Drawings

ALKALI METAL BORATE AND LUBRICATING COMPOSITIONS THEREOF

This is a divisional of U.S. Ser. No. 12/525,702, filed Dec. 15, 2009, now U.S. Pat. No. 8,193,130 B2 issued Jun. 5, 2012.

FIELD OF INVENTION

The present invention relates to a lubricating composition containing an alkali metal borate. The invention further provides for a method of lubricating a device with a grease or a metalworking fluid by employing the lubricating composition containing the alkali metal borate.

BACKGROUND OF THE INVENTION

One of the important parameters influencing durability or wear resistance of mechanical devices employing a lubricating composition is the effectiveness of antiwear or extreme pressure additives at providing devices with appropriate protection under various conditions of load and speed. However, the working environment of lubricating is becoming more severe due to factors such as a size reduction of mechanical devices, or increasing speed and loads being exerted.

In order to lubricate the mechanical devices, metalworking fluids, greases and other lubricants have been formulated with additives providing extreme pressure and antiwear performance. Known additives include antimony dialkyldithiocarbamates, molybdenum sulphides (such as $MoS_2$), phosphorus containing agents (such as zinc dialkyldithiophosphates) and boron-containing additives (such as borated esters, borated dispersants, and alkali metal borates). The alkali metal borates are commonly sold as a solid lubricant. However, the particle size of the alkali metal borates is believed to be sufficiently large thus giving a lubricant (such as a grease) a grainy appearance and with limited handle-ability. Attempts have been made to prepare a lubricant containing a dispersed alkali metal borate.

U.S. Pat. No. 5,877,129 discloses a grease composition containing a lubricant additive, wherein the lubricant additive is derived from a borate dispersion of an alkali metal salt of salicylic acid and an alkenyl succinimide. The lubricant additive provides a grease with a high dropping point and antioxidant performance.

U.S. Pat. No. 6,737,387 discloses a dispersed hydrate potassium borate composition containing a dispersant, base oil and hydrate potassium borate characterised as having a hydroxyl to boron ratio of at least 1.2:1 to about 1.5:1, a potassium to boron ratio of about 1:2.75 to 1:3.25 and a turbidity value of less than about 75 ntu.

U.S. Pat. No. 6,632,781 discloses a lubricant composition containing base oil, a dispersed hydrated alkali metal borate and a metal salt of polyisobutenyl sulphonate, wherein the polyisobutenyl moiety has a number average molecular weight of 400 to 1200.

International Application WO 00/63324 discloses a lubricant composition containing a base oil of lubricating viscosity, a dispersed hydrated alkali metal borate and a dispersant selected from the group consisting of a polyalkylene succinic anhydride and a non-nitrogen containing derivative of said polyalkylene succinic anhydride. In one embodiment the hydrated alkali metal borate is a sodium borate with a sodium to boron ratio of about 1:3.

US Patent Application 2002/0147115 discloses a lubricant composition containing a base oil of lubricating viscosity, a dispersed hydrated alkali metal borate and a dispersant selected from the group consisting of a polyalkylene succinic anhydride and a non-nitrogen containing derivative of said polyalkylene succinic anhydride. In one embodiment the hydrated alkali metal borate is a sodium borate with a sodium to boron ratio of about 1:2.5 to 1:4.5.

US Patent Application 2004/0087450 discloses lubricating an internal combustion engine with a lubricant composition containing a dispersed hydrated alkali metal borate, and at least one phosphorus-containing antiwear agent providing up to 0.08 weight percent phosphorus.

In addition, due to increasing environmental concerns and increasingly tighter health and safety legislation specifies, chemistry containing, for example, heavy metals (antimony and others), phosphorus, and sulphur are becoming less desirable.

Consequently, it would be desirable to provide a lubricating composition capable of providing at least one property including acceptable antiwear performance, and acceptable extreme pressure performance, acceptable dropping point performance, acceptable penetration (or consistency), acceptable handle-ability, acceptable environmental impact, and acceptable performance in view of health and safety legislation. The present invention provides a lubricating composition capable of providing at least one of the properties listed above. The present invention further provides methods of lubricating mechanical devices with the lubricating composition.

SUMMARY OF THE INVENTION

In one embodiment the invention provides a lubricating composition comprising: (a) an oil of lubricating viscosity; (b) an alkali metal borate dispersion, wherein the alkali metal borate has a mole ratio of 1 alkali metal to greater than 3.25 of boron; and (c) optionally a grease thickener.

In one embodiment the invention provides a lubricating composition comprising: (a) a dispersion obtained/obtainable from physical processing: (i) an alkali metal borate dispersion, wherein the alkali metal borate has a mole ratio of 1 alkali metal to greater than 3.25 of boron; (ii) a surfactant; and (iii) an oil of lubricating viscosity; and (b) optionally a grease thickener.

In one embodiment the invention provides a method of lubricating a mechanical device comprising supplying to the mechanical device a lubricating composition comprising: (a) an oil of lubricating viscosity; (b) an alkali metal borate dispersion, wherein the alkali metal borate has a mole ratio of 1 alkali metal to greater than 3.25 of boron; and (c) optionally a grease thickener.

In one embodiment the invention provides a method of lubricating a mechanical device comprising supplying to the mechanical device a lubricating composition comprising: (a) a dispersion obtained/obtainable from physical processing: (i) an alkali metal borate, wherein the alkali metal borate has a mole ratio of 1 alkali metal to greater than 3.25 of boron; (ii) a surfactant; and (iii) an oil of lubricating viscosity; and (b) optionally a grease thickener.

In one embodiment the lubricating composition described herein further comprises a grease thickener.

In one embodiment the lubricating composition described herein does not include a grease thickener.

In one embodiment the invention provides for the use the alkali metal borate dispersion described herein as an antiwear agent or extreme pressure agent for either (i) a grease, or (ii) a metalworking fluid.

DETAILED DESCRIPTION OF THE INVENTION

The present invention provides a lubricating composition; and a method for lubricating a mechanical device as disclosed above.

In different embodiments the lubricating composition has a nephelometric turbidity unit (ntu) of more than about 4000 when undiluted, or about 500 to about 3500, or about 800 to about 3000 when blended at about 5% in about 100 neutral oil.

In one embodiment the lubricating composition is free of antimony dihydrocarbyldithiocarbamate.

In one embodiment the lubricating composition is free of molybdenum disulphide.

Alkali Metal Borate

In one embodiment the alkali metal borate includes a crystalline alkali metal pentaborate.

In one embodiment the alkali metal borate includes a potassium borate, a sodium borate, or mixtures thereof. In one embodiment the alkali metal borate includes a potassium borate. In one embodiment the alkali metal borate includes a potassium pentaborate.

In different embodiments, the alkali metal borate has a mole ratio of alkali metal to boron of about 1:3.5 to about 1:10, or about 1:4 to about 1:8, or about 1:4.2 to about 1:6.

In different embodiments the physical processing results in the alkali metal borate having a mean particle size of about 10 nanometers to about 10 μm, or about 50 nanometers to about 5 μm, or about 100 nanometers to about 1 μm.

Physical Processes

Examples of the physical process include static mixing, milling, grinding, crushing, agitating, ultra-sonic radiating, or mixtures thereof. The physical process typically requires one or more of static mixing, milling, grinding, crushing, agitating, or ultra-sonic radiating.

Milling processes include a rotor stator mixer, a vertical bead mill, a horizontal bead mill, basket milling, ball mill, pearl milling or mixtures thereof. In one embodiment, the physical process for preparing the suspension comprises milling in a vertical or horizontal bead mill.

In different embodiments the milling process may be carried out in a vertical or horizontal bead mill. Either bead mill processes cause the reduction of particle size of the metal base by high energy collisions of the metal base with at least one bead; and/or other metal base agglomerates, aggregates, solid particles; or mixtures thereof. The beads typically have a mean particle size and mass greater than the desired mean particle size of the metal base. In some instances the beads are a mixture of different mean particle size.

In different embodiments the physical processing results in the alkali metal borate having a mean particle size of about 10 nanometers to about 10 μm, or about 50 nanometers to about 5 μm, or about 100 nanometers to about 1 μm.

The mill typically contains beads present at least about 40 vol %, or at least about 60 vol % of the mill. A range include for example about 60 vol % to about 95 vol %.

Surfactant

The surfactant includes an ionic (cationic or anionic) or non-ionic compound. Generally, the surfactant stabilises the dispersion of the alkali metal borate in the oil of lubricating viscosity.

Suitable surfactant compounds include those with a hydrophilic lipophilic balance (HLB) ranging of about 1 to about 40, or about 1 to about 20, or about 1 to about 18, or about 2 to about 16, or about 2.5 to about 15. In different embodiments the HLB may be about 11 to about 14, or less than about 10 such as about 1 to about 8, or about 2.5 to about 6. Those skilled in the art will appreciate that combinations of surfactants may be used with individual HLB values outside of these ranges, provided that the composition of a final surfactant blend is within these ranges. When the surfactant has an available acidic group, the surfactant may become the metal salt of the acidic group and where the metal is derived from the alkali metal borate.

Examples of these surfactants suitable for the invention are disclosed in *McCutcheon's Emulsifiers and Detergents,* 1993, North American & International Edition. Generic examples include alkanolamides, alkylarylsulphonates, amine oxides, poly(oxyalkylene) compounds, including block copolymers comprising alkylene oxide repeat units (e.g., Pluronic™), carboxylated alcohol ethoxylates, ethoxylated alcohols, ethoxylated alkyl phenols, ethoxylated amines and amides, ethoxylated fatty acids, ethoxylated fatty esters and oils, fatty esters, glycerol esters, glycol esters, imidazoline derivatives, phenates, lecithin and derivatives, lignin and derivatives, monoglycerides and derivatives, olefin sulphonates, phosphate esters and derivatives, propoxylated and ethoxylated fatty acids or alcohols or alkyl phenols, sorbitan derivatives, sucrose esters and derivatives, sulphates or alcohols or ethoxylated alcohols or fatty esters, polyisobutylene succinimide and derivatives.

In one embodiment the surfactant comprises polyesters as defined in column 2, line 44 to column 3, line 39 of U.S. Pat. No. 3,778,287. Examples of suitable polyester surfactants are prepared in U.S. Pat. No. 3,778,287 as disclosed in Polyester Examples A to F (including salts thereof).

In one embodiment the surfactant is a hydrocarbyl substituted aryl sulphonic acid (or sulphonate) of an alkali metal, alkaline earth metal or mixtures thereof. The hydrocarbyl substituted aryl sulphonic acid may be synthetic or natural. The aryl group of the aryl sulphonic acid may be phenyl, tolyl or naphthyl. In one embodiment the hydrocarbyl substituted aryl sulphonic acid comprises alkyl substituted benzene sulphonic acid. In one embodiment the surfactants is a hydrocarbyl-substituted sulphonic acid, such as, polypropene benzenesulphonic acid, $C_{16}$-$C_{36}$ alkyl benzenesulphonic acid, and $C_{16}$-$C_{26}$ alkyl benzenesulphonic acid or mixtures thereof.

The hydrocarbyl (especially an alkyl) group typically contains 8 to 30, or about 10 to about 26, or about 10 to about 15 carbon atoms. In one embodiment the surfactant is a mixture of about $C_{10}$ to about $C_{15}$ alkylbenzene sulphonic acids. Examples of sulphonates include dodecyl and tridecyl benzenes or condensed naphthalenes or petroleum, sulphosuccinates and derivatives.

In one embodiment the surfactant is in the form of a neutral or overbased surfactant of a neutral or overbased surfactant typically salted with an alkali or alkaline earth metal. The alkali metal includes lithium, potassium or sodium; and the alkaline earth metal includes calcium or magnesium. In one embodiment the alkali metal is sodium. In one embodiment the alkaline earth metal is calcium.

In one embodiment the alkali metal borate dispersion is substantially free of, to free of an alkaline earth metal salt of a salicylic acid surfactant.

In one embodiment the alkali metal borate dispersion is substantially free of, to free of an alkaline earth metal salt of a polyalkenyl sulphonate, wherein the polyalkenyl group has a number average molecular weight of 400 or higher.

In one embodiment the alkali metal borate dispersion is substantially free of, to free of an alkaline earth metal salt of a polyalkenyl sulphonate.

Typical examples of a polyolefin include polyisobutene; polypropylene; polyethylene; a copolymer derived from isobutene and butadiene; a copolymer derived from isobutene and isoprene; or mixtures thereof.

In one embodiment the surfactant is a derivative of a polyolefin. Typically the derivative of a polyolefin comprises a polyolefin-substituted acylating agent optionally further reacted to form an ester and/or aminoester. The acylating agent may be a compound with one or more acid functional groups, such as a carboxylic acid or anhydride thereof. Examples of an acylating agent include an alpha, beta-unsaturated mono- or polycarboxylic acid, anhydride ester or derivative thereof. Examples of an acylating agent include (meth)acrylic acid, methyl (meth)acrylate, maleic acid or anhydride, fumaric acid, itaconic acid or anhydride, or mixtures thereof, where (meth) acrylic means acrylic or methacrylic.

In one embodiment the polyolefin is a derivative of polyisobutene with a number average molecular weight of at least about 250, about 300, about 500, about 600, about 700, or about 800, to about 5000 or more, or up to about 3000, about 2500, about 1600, about 1300, or about 1200. In one embodiment less than about 5% by weight of the polyisobutylene used to make the derivative molecules have $\overline{Mn}$ less than about 250, more. In one embodiment the polyisobutylene used to make the derivative has $\overline{Mn}$ of at least about 800. In different embodiments the polyisobutylene used to make the derivative contains at least about 30% terminal vinylidene groups, or at least about 60% or at least about 75% or about 85% terminal vinylidene groups. In one embodiment the polyisobutylene used to make the derivative may have a polydispersity, $\overline{Mw}/\overline{Mn}$, greater than about 5, or about 6 to about 20. In different embodiments the polyisobutylene used to make the derivative may have a polydispersity, $\overline{Mw}/\overline{Mn}$ of about 1 to about 5, or about 2 to about 4.

In various embodiments, the polyisobutene is substituted with succinic anhydride, the polyisobutene substituent has a number average molecular weight ranging from about 1,500 to about 3,000, or about 1,800 to about 2,300, or about 700 to about 1700, or about 800 to about 1000. The ratio of succinic groups per equivalent weight of the polyisobutene typically ranges from about 1.3 to about 2.5, or about 1.7 to about 2.1, or about 1.0 to about 1.3, or about 1.0 to about 1.2.

In one embodiment the surfactant is polyisobutenyl-dihydro-2,5-furandione ester with pentaerythritol or mixtures thereof. In one embodiment the surfactant is a polyisobutylene succinic anhydride derivative such as a polyisobutylene succinimide or derivatives thereof Other typical derivatives of polyisobutylene succinic anhydrides include hydrolysed succinic anhydrides, esters or diacids. Polyisobutylene succinic anhydride derivatives are preferred to make the alkali metal borate dispersions. A large group of polyisobutylene succinic anhydride derivatives are taught in U.S. Pat. No. 3,172,892, U.S. Pat. No. 4,708,753, and U.S. Pat. No. 4,234,435.

In different embodiments the surfactant is substantially free of, to free of, phospholipids, (such as lecithin) and/or amino acids (such as sarcosines).

In one embodiment the surfactant has a molecular weight of less than 1000, in another embodiment less than about 950, for example, about 250, about 300, about 500, about 600, about 700, or about 800.

In one embodiment the surfactant is selected from the group consisting of a C8-30-hydrocarbyl substituted sulphonate, a succinimide, a succinate, and mixtures thereof.

In one embodiment the alkali metal borate dispersion contains not more than one surfactant.

The amount of surfactant, alkali metal borate, and oil of lubricating viscosity in the dispersion may vary as is shown in Table 1.

TABLE 1

| | Embodiments (wt % in Dispersion) | | | |
|---|---|---|---|---|
| | 1 | 2 | 3 | 4 |
| Alkali Metal Borate | 20-90 | 30-80 | 40-70 | 45-65 |
| Surfactant | 0.1-30 | 3-25 | 5-20 | 7-15 |
| Oil of Lubricating Viscosity | 9.9-79.9 | 17-67 | 25-55 | 28-48 |

Oils of Lubricating Viscosity

The lubricating oil composition includes natural or synthetic oils of lubricating viscosity, oil derived from hydrocracking, hydrogenation, hydrofinishing, and unrefined, refined and re-refined oils and mixtures thereof Natural oils include animal oils, vegetable oils, mineral oils and mixtures thereof. Synthetic oils include hydrocarbon oils, silicon-based oils, and liquid esters of phosphorus-containing acids. Synthetic oils may be produced by Fischer-Tropsch gas-to-liquid synthetic procedure as well as other gas-to-liquid oils. In one embodiment the composition of the present invention is useful when employed in a gas-to-liquid oil. Often Fischer-Tropsch hydrocarbons or waxes may be hydroisomerised.

In one embodiment the base oil comprises a polyalphaolefin including a PAO-2, PAO-4, PAO-5, PAO-6, PAO-7 or PAO-8. The polyalphaolefin in one embodiment is prepared from dodecene and in another embodiment from decene.

In one embodiment the oil of lubricating viscosity is an ester such as an adipate.

In one embodiment the oil of lubricating viscosity is at least in-part a polymer (may also be referred to as a viscosity modifier) including hydrogenated copolymers of styrene-butadiene, ethylene-propylene polymers, polyisobutenes, hydrogenated styrene-isoprene polymers, hydrogenated isoprene polymers, polymethacrylate acid esters, polyacrylate acid esters, polyalkyl styrenes, alkenyl aryl conjugated diene copolymers, polyolefins, polyalkylmethacrylates and esters of maleic anhydride-styrene copolymers. In different embodiments the polymer includes polymethacrylate acid esters, polyacrylate acid esters, polyalkylmethacrylates and esters of maleic anhydride-styrene copolymers, polyisobutenes or mixtures thereof.

Oils of lubricating viscosity may also be defined as specified in the American Petroleum Institute (API) Base Oil Interchangeability Guidelines. In one embodiment the oil of lubricating viscosity comprises an API Group I, II, III, IV, V, VI base oil, or mixtures thereof, and in another embodiment API Group II, III, IV base oil or mixtures thereof. In another embodiment the oil of lubricating viscosity is a Group I or II base oil and in another embodiment a Group III base oil.

The amount of the oil of lubricating viscosity present, is typically the balance remaining after subtracting from about 100 wt % the sum of the amount of the compounds of the present invention.

In one embodiment the lubricating composition is in the form of a concentrate and/or a fully formulated lubricant. The ratio of the alkali metal borate dispersion and/or the other performance additives of the lubricating composition to the oil of lubricating viscosity and/or to diluent oil include the ranges of about 1:99 to about 99:1 by weight, or about 80:20 to about 10:90 by weight.

Grease Thickener

In one embodiment the lubricating composition described herein further comprises a grease thickener. When the lubricating composition comprises a grease thickener, the composition may be described as a grease composition.

The grease thickener includes materials derived from (i) inorganic powders such as clay, organo-clays, bentonite, fumed silica, calcite, carbon black, pigments, copper phthalocyanine or mixtures thereof, (ii) a carboxylic acid and/or ester (such as a mono- or poly-carboxylic acid and/or ester thereof), (iii) a polyurea or diurea, or mixtures thereof.

In one embodiment the grease thickener is a non-soap based thickener derived from material such as a silica, clay, or other filler type.

In one embodiment the grease thickener is derived from calcite. Typically a calcite thickener is in the form of an overbased calcium sulphonate or carboxylates are used. In one embodiment the grease thickener is derived from an overbased calcium sulphonate.

The carboxylic acid and/or ester thereof include a mono- or poly-carboxylic acid and/or ester thereof, or a mixture of two or more thereof. The polycarboxylic acid and/or ester may be a di-carboxylic acid and/or ester thereof.

Typically grease thickener is derived from a metal salt of a carboxylic acid and/or ester. Often the metal includes an alkali metal, alkaline metal, aluminium, titanium, or mixtures thereof. Examples of suitable metals include lithium, potassium, sodium, calcium, magnesium, barium, aluminium, titanium, and mixtures thereof. In one embodiment the metal includes lithium, calcium, aluminium or mixtures thereof. In one embodiment the metal includes lithium. In one embodiment the metal includes calcium.

In one embodiment the ester of the dicarboxylic acid includes a diester. In one embodiment the carboxylic acid and/or ester includes one or more branched alicyclic or linear, saturated or unsaturated, mono- or poly-hydroxy substituted or unsubstituted carboxylic acids and/or esters. In one embodiment the carboxylic acid includes one or more acid chlorides. In one embodiment the carboxylic acid ester includes one or more esters of one or more of the carboxylic acids with one or more alcohols. The alcohols may be alcohols of 1 to about 5 carbon atoms. In different embodiments, the carboxylic acids contain about 2 to about 30, or about 4 to about 30, or about 8 to about 27, or about 12 to about 24, or about 16 to about 20 carbon atoms per molecule.

In one embodiment the carboxylic acid and/or ester thereof includes one or more monocarboxylic acids and/or esters thereof, one or more dicarboxylic acids and/or esters thereof, or a mixture of two or more thereof. In one embodiment the carboxylic acid includes an alkanoic acid. In one embodiment the carboxylic acid and/or ester thereof includes a mixture of one or more dicarboxylic acids and/or esters thereof and/or one or more polycarboxylic acids and/or esters thereof. In one embodiment the carboxylic acid and/or ester thereof includes a mixture of one or more monocarboxylic acids and/or ester thereof, and one or more dicarboxylic and/or polycarboxylic acids and/or esters thereof.

In different embodiments, the weight ratio of dicarboxylic and/or polycarboxylic acid and/or ester thereof to monocarboxylic acid and/or ester thereof may be in a range including about 5:95 to about 60:40, or about 10:90 to about 50:50, or about 20:80 to about 40:60, or about 30:70.

In one embodiment the carboxylic acid and/or ester thereof includes one or more hydroxystearic acids and/or esters of these acids. Examples of a suitable hydroxystearic acid include 9-hydroxy stearic acid, 10-hydroxy stearic acid, 12-hydroxy stearic acid, or a mixture of two or more thereof. The esters may comprise one or more methyl esters or natural esters such as methyl 9-hydroxy stearate, methyl 10-hydroxy stearate, methyl 12-hydroxy stearate, hydrogenated castor bean oil, or a mixture of two or more thereof.

In one embodiment the carboxylic acid includes lauric acid, myristic acid, palmitic acid, arachidic acid, behenic acid and/or lignoceric acid. In one embodiment the carboxylic acid includes one or more of undecylenic acid, myristoleic acid, palmitoleic acid, oleic acid, gadoleic acid, elaidic acid, cis-eicosenoic acid, erucic acid, nervonic acid, 2,4-hexadienoic acid, linoleic acid, 12-hydroxy tetradecanoic acid, 10-hydroxy tetradecanoic acid, 12-hydroxy hexadecanoic acid, 8-hydroxy hexadecanoic acid, 12-hydroxy icosanic acid, 16-hydroxy icosanic acid 11,14-eicosadienoic acid, linolenic acid, cis-8,11,14-eicosatrienoic acid, arachidonic acid, cis-5,8,11,14,17-eicosapentenoic acid, cis-4,7,10,13,16,19-docosahexenoic acid, all-trans-retinoic acid, ricinoleic acid lauroleic acid, eleostearic acid, licanic acid, citronelic acid, nervonic acid, abietic acid, abscisic acid, or a mixture of two or more thereof. In one embodiment the carboxylic acid includes palmitoleic acid, oleic acid, linoleic acid, linolenic acid, licanic acid, eleostearic acid, or a mixture of two or more thereof.

In one embodiment the grease thickener includes 12-hydroxystearic acid, and salts thereof.

In one embodiment the carboxylic acid includes iso-octanedioic acid, octanedioic acid, nonanedioic acid (azelaic acid), decanedioic acid (sebacic acid), undecanedioic acid, dodecanedioic acid, tridecanedioic acid, tetradecanedioic acid, pentadecanoic acid, or a mixture of two or more thereof. In one embodiment the carboxylic acid includes nonanedioic acid (azelaic acid). In one embodiment the carboxylic acid includes decanedioic acid (sebacic acid). The reactive carboxylic acid functional groups may be delivered by esters such as dimethyl adipate, dimethyl nonanedioate (azelate), dimethyl decanedioate (sebacate), diethyl adipate, diethyl nonanedioate (azelate), diethyl decanedioate (diethyl sebacate), or mixtures of two or more thereof.

In one embodiment the grease thickener comprises polyurea thickener formed by reacting diisocyanates with amines to form (i) a diurea such as the reaction product of methylene diisocynate or toluene disocyanate with a monoamine such as stearylamine or oleylamine, (ii) a polyurea such as the reaction product of methylene diisocyanate or toluene diisocyanate with ethylene diamine in a first step and a fatty amine such as stearylamine or oleylamine in a second step to give a mixture of oligomers have more than two urea linkages per molecule and some having two linkages per molecule, (iii) a polyurea complex formed by utilizing the calcium salt of a low molecular weight acid such as acetic acid or carbonic acid in combination with polyurea to thicken grease.

In one embodiment the grease thickener consists of a polyurea or diurea comprised of reacting a diisocynate with fatty amine or polyamine and fatty amine.

The grease thickener is present in different embodiments in a range selected from the group consisting of about 3 to about 40, about 4 to about 35, about 4 to about 30, about 5 to about 25 and about 5 to about 20 weight percent of the grease composition. The grease thickener may be used alone or in combination.

Other Performance Additives for a Grease Composition

Optionally, the grease composition may further comprise one or more other performance additives. The other performance additives include metal deactivators, antioxidants, antiwear agents, rust inhibitors, viscosity modifiers, extreme pressure agents, or a mixture of two or more thereof.

Metal deactivators include for example, one or more derivatives of benzotriazole, benzimidazole, 2-alkyldithiobenz-imidazoles, 2-alkyldithiobenzothiazoles, 2-(N, N-dialkyldithiocarbamoyl)-benzothiazoles, 2,5-bis(alkyldithio)-1,3,4-thiadiazoles, 2,5-bis(N,N-dialkyldithiocarbamoyl)-1,3,4-thiadiazoles, 2-alkyldithio-5-mercapto thiadiazoles or mixtures thereof.

The benzotriazole compounds may include hydrocarbyl substitutions at one or more of the following ring positions 1- or 2- or 4- or 5- or 6- or 7-benzotriazoles. The hydrocarbyl groups may contain from 1 to about 30 carbons, and in one embodiment from 1 to about 15 carbons, and in one embodiment from 1 to about 7 carbons. The metal deactivator include 5-methylbenzotriazole (tolyl triazole).

The metal deactivator may be present in a grease composition at a concentration in a range selected from the group consisting of about 0 wt % to about 5 wt %, about 0.0002 wt % to about 2 wt %, and about 0.001 wt % to about 1 wt %.

Antioxidants include phosphosulphurised terpenes, sulphurised esters, aromatic amines, and hindered phenols, or a mixture of two or more thereof.

The antioxidant may be present in a grease composition at a concentration in a range selected from the group consisting of about 0 wt % to about 12 wt %, and about 0.1 wt % to about 6 wt %, and about 0.25 wt % to about 3 wt %.

Antiwear agents include one or more metal thiophosphates. These may include zinc dialkyldithiophosphate, a phosphoric acid ester or salt thereof, a phosphite, or a phosphorus-containing ester, ether, or amide.

The antiwear agent may be present in a grease composition at a concentration in a range selected from the group consisting of about 0 wt % to about 10 wt %, and about 0.1 wt % to about 5 wt %.

Rust inhibitors include one or more metal sulphonates such as calcium sulphonate or magnesium sulphonate, amine salts of carboxylic acids such as octylamine octanoate, condensation products of dodecenyl succinic acid or anhydride and a fatty acid such as oleic acid with a polyamine, e.g. a polyalkylene polyamine such as triethylenetetramine, or half esters of alkenyl succinic acids in which the alkenyl group contains from about 8 to about 24 carbon atoms with alcohols such as polyglycols.

The rust inhibitors may be present in a grease composition at a concentration in a range selected from the group consisting of about 0 wt % to about 4 wt %, about 0.02 wt % to about 2 wt %, and about 0.05 wt % to about 1 wt %.

Viscosity modifiers include one or more polymeric materials including styrene-butadiene rubbers, ethylene-propylene copolymers, polyisobutenes, hydrogenated styrene-isoprene polymers, hydrogenated radical isoprene polymers, polymethacrylate acid esters, polyacrylate acid esters, polyalkyl styrenes, alkenyl aryl conjugated diene copolymers, polyolefins, polyalkylmethacrylates, esters of maleic anhydride-styrene copolymers and mixtures thereof.

The viscosity modifier may be present in a grease composition at a concentration in a range selected from the group consisting of 0 wt % to about 30 wt %, about 0.5 wt % to about 20 wt %, and about 1 wt % to about 5 wt %.

Extreme pressure (EP) agents that may be used may include one or more sulphur or chlorosulphur EP agents, chlorinated hydrocarbon EP agents, phosphorus EP agents, or mixtures of two or more thereof. Examples of such EP agents may include chlorinated wax, organic sulphides and polysulphides, such as benzyldisulphide, bis-(chlorobenzyl)disulphide, dibutyl tetrasulphide, sulphurised sperm oil, sulphurised methyl ester of oleic acid, sulphurised alkylphenol, sulphurised dipentene, sulphurised terpene, and sulphurised Diels-Alder adducts; phosphosulphurised hydrocarbons, such as the reaction product of phosphorus sulphide with turpentine or methyl oleate, phosphorus esters such as the dihydrocarbon and trihydrocarbon phosphites, i.e., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid, zinc dicyclohexyl phosphorodithioate and the zinc salts of a phosphorodithioic acid combination.

The extreme pressure agents may be present in a grease composition at a concentration in a range selected from the group consisting of about 0 wt % to about 10 wt %, about 0.25 to about 5 wt %, and about 0.5 to about 2.5 wt %.

Other Performance Additives for a Metalworking Composition

In one embodiment the lubricating composition suitable for a metalworking fluid further comprises other performance additives. The other performance additives are typically selected from the group consisting of antifoam agents, odor masking agents, metal deactivators, antimicrobial agents and antirust agents.

Often the odor masking agents include green apple, Mulberry, Watermelon, Cherry, Fruit Slices, and Lemon (all commercially available from International Fragrance and Technology and other similar companies). Useful antifoam agents include alkyl polymethacrylates. Useful metal deactivators include triazoles such as tolyl triazole.

Process to Prepare Grease and Metalworking Compositions

In one embodiment the invention provides a process for preparing a grease composition comprising: blending (a) an oil of lubricating viscosity; (b) an alkali metal borate dispersion, wherein the alkali metal borate has a mole ratio of 1 alkali metal to greater than 3.25 of boron; (c) a grease thickener; and (d) optionally other performance additives, to form a grease.

In one embodiment the invention provides a process for preparing a grease composition comprising steps of:

(1) forming a dispersion obtained/obtainable from physical processing, wherein the dispersion comprises (i) an alkali metal borate, wherein the alkali metal borate has a mole ratio of 1 alkali metal to greater than 3.25 of boron; (ii) a surfactant; and (iii) an oil of lubricating viscosity;

(2) optionally blending the dispersion of step (1) with an oil of lubricating viscosity; and (3) blending the product of either step (1) and/or step (2) with a grease thickener.

In one embodiment the invention provides a method of lubricating a device with a metalworking fluid comprising supplying to the device a lubricating composition disclosed herein. Typically, a metalworking fluid may be prepared by a process comprising the steps of:

(1) forming a dispersion obtained/obtainable from physical processing, wherein the dispersion comprises (i) an alkali metal borate, wherein the alkali metal borate has a mole ratio of 1 alkali metal to greater than 3.25 of boron; (ii) a surfactant; and (iii) an oil of lubricating viscosity; and (2) optionally blending the dispersion of step (1) with an oil of lubricating viscosity.

Typically the metalworking fluid does not contain a grease thickener.

Methods of forming the dispersion are obtained/obtainable from physical processing known in the art, for example in WO2005/097952 (although WO2005/097952 does not disclose alkali metal borates, the methodology is similar). For example a slurry of alkali metal borate, surfactant and oil is prepared by mixing and then grinding using a vertical bead mill until the desired particle size of the alkali metal borate is obtained. Typical dispersions formed have composition described in Table 1 above.

In one embodiment the process comprises step (2) of the process described above. In one embodiment the product of step (2) is a concentrate.

In one embodiment other performance additives may be added to either (or both of) steps (2) and/or (3) of the process.

The process for making grease includes a batch, semi-continuous or a non-batch process.

Typically the process to prepare the dispersion utilizes less than 20 wt % of water, or less than 10 wt % of water, or about 0 wt % to about 2 wt %, or about 0 wt % of water based on the weight of the dispersion. A dispersion prepared in the presence of water as dispersion medium is less desirable because the resultant dispersion typically requires an additional heating step to remove excess water.

As used herein, the water described above does not include any water of crystalisation or hydration.

INDUSTRIAL APPLICATION

The method of the invention is useful for lubricating a variety of mechanical devices that require a grease and/or a metalworking fluid.

The grease includes complex soap greases, lithium complex soap greases, calcium soap greases, low noise soap greases, and short fiber high soap content greases. The low noise greases may be used in rolling element bearing applications such as pumps or compressors. The complex soap greases may be smooth or show grain. The complex greases may contain a polycarboxylic acid, for example, a dicarboxylic acid.

The metalworking fluid includes reaming fluids, rolling fluids, cutting fluid, pressing fluids, and forming fluid. The following examples provide illustrations of the invention. These examples are non-exhaustive and are not intended to limit the scope of the invention.

EXAMPLES

Preparative Example 1

Dispersion Preparation

A dispersion is prepared by blending about 3.9 kg potassium pentaborate tetrahydrate, about 0.79 kg polyisobutylene succinic acid (about 25% oil) and about 3.1 kg of an oil of lubricating viscosity, to form a slurry. The slurry is then agitated in a using a lab scale Dyno-Mill ECM Multi-Lab horizontal bead mill commercially available from W.A.B. A.G., Basel using about 0.5 mm Yttria-treated Zirconia (YTZ) beads with a rotor tip speed of about 14 $m/s^{-1}$ and maximum outlet temperature of about 71° C. The resultant dispersion contains about 10 wt % of surfactant, about 40 wt % of an oil of lubricating viscosity, about 50 wt % of pentaborate tetrahydrate (identified by x-ray diffraction), and has a particle size of about 0.46 microns measured using a Coulter LS-230. The dispersion has a NTU of greater than 4000 (when neat), and a NTU of 1607 (for about 5 volume percent).

Preparative Example 2

Dispersion Preparation

A dispersion is prepared by blending about 4.22 kg potassium pentaborate tetrahydrate, about 0.84 kg polyisobutylene succinimide (about 30% oil) and about 3.4 kg of an oil of lubricating viscosity, to form a slurry. The slurry is then agitated in a using a lab scale Dyno-Mill ECM Multi-Lab horizontal bead mill commercially available from W.A.B. A.G., Basel using about 0.5 mm YTZ beads with a rotor tip speed of about 14 $m/s^{-1}$ and maximum outlet temperature of about 73° C. The resultant dispersion contains about 10 wt % of surfactant, about 40 wt % of an oil of lubricating viscosity, about 50 wt % of pentaborate tetrahydrate (identified by x-ray diffraction), and has a particle size of about 1.0 micron measured using a Coulter LS-230. The dispersion has a NTU of greater than 4000 (when neat), and a NTU of about 2223 (for about 5 volume percent).

Preparative Example 3

Dispersion Preparation

A dispersion is prepared by blending about 4.2 kg potassium pentaborate tetrahydrate, about 0.84 kg polyisobutylene succinic acid ester (about 44% oil) and about 3.37 kg of an oil of lubricating viscosity, to form a slurry. The slurry is then agitated in a using a lab scale Dyno-Mill ECM Multi-Lab horizontal bead mill commercially available from W.A.B. A.G., Basel using about 0.5 mm YTZ beads with a rotor tip speed of about 14 $m/s^{-1}$ and maximum outlet temperature of about 80° C. The resultant dispersion contains about 10 wt % of surfactant, about 40 wt % of an oil of lubricating viscosity, about 50 wt % of pentaborate tetrahydrate (identified by x-ray diffraction), and has a particle size of 1.7 micron measured using a Coulter LS-230. The dispersion has a NTU of greater than 4000 (when neat), and a NTU of about 3150 (for about 5 volume percent).

Preparative Example 4

Dispersion Preparation

A dispersion is prepared by blending about 4.2 kg potassium pentaborate tetrahydrate, about 0.84 kg polyisobutylene succinic acid/ester/salt product with diethylethanolamine (about 33% oil) and about 3.34 kg of an oil of lubricating viscosity, to form a slurry. The slurry is then agitated in a using a lab scale Dyno-Mill ECM Multi-Lab horizontal bead mill commercially available from W.A.B. A.G., Basel using about 0.5 mm YTZ beads with a rotor tip speed of about 14 $m/s^{-1}$ and maximum outlet temperature of about 70° C. The resultant dispersion contains about 10 wt % of surfactant, about 40 wt % of an oil of lubricating viscosity, about 50 wt % of pentaborate tetrahydrate (identified by x-ray diffraction), and has a particle size of about 1.0 micron measured using a Coulter LS-230. The dispersion has a NTU of greater than 4000 (when neat), and a NTU of about 2235 (for about 5 volume percent).

Preparative Example 5

Dispersion Preparation

A dispersion is prepared by blending about 4.2 kg potassium pentaborate tetrahydrate, about 0.84 kg polyisobutylene succinic acid (about 25% oil) and about 3.34 kg of an oil of lubricating viscosity, to form a slurry. The slurry is then agitated in a using a lab scale Dyno-Mill ECM Multi-Lab horizontal bead mill commercially available from W.A.B. A.G., Basel using about 0.5 mm YTZ beads with a rotor tip speed of about 14 $m/s^{-1}$ and maximum outlet temperature of about 68° C. The resultant dispersion contains about 10 wt % of surfactant, about 40 wt % of an oil of lubricating viscosity, about 50 wt % of pentaborate tetrahydrate (identified by x-ray diffraction), and has a particle size of 4.8 micron measured using a Coulter LS-230. The dispersion has a NTU of greater than 4000 (when neat), and a NTU of about 2559 (for about 5 volume percent).

Grease Examples

Grease Examples 1 to 5 (GR1 to GR5 respectively) are prepared by known processes and employing a dispersion as prepared in Preparative Examples 1 to 5.

Grease Examples 6 to 10 (GR6 to GR10 respectively) are similar to GR1 to GR5, except about 4 wt % of a zinc dialkyldithiophosphate is present in each grease.

Comparative Example 1 (CE1) is a lithium complex grease blended with solid potassium pentaborate tetrahydrate.

Comparative Example 2 (CE2) is similar to CE1, except CE2 further contains about 4 wt % of a zinc dialkyldithiophosphate.

The grease compositions (GR1 to GR10, CE1 and CE2) are evaluated by employing the methodologies of ASTM Methods D217 (grease consistency/penetration), D2596 (4-ball extreme pressure test), D2266 (4-ball antiwear test), D2265 (grease dropping point), and D2509 (Timken extreme pressure test). The results indicate that the compositions of the invention and the comparative example have acceptable performance in D217, D2596, and D2266 tests. The results obtained for D2265 and D2509 tests are:

| | CE1 | GR2 | GR5 | CE2 | GR7 | GR8 | GR10 |
|---|---|---|---|---|---|---|---|
| weight percent solids delivered by dispersion | 3 | 3 | 3 | 3 | 3 | 3 | 3 |
| D2265 (° C.) | 204 | 277 | 260 | 217 | 283 | 265 | 277 |
| D2509 (Kg) | 8.8 | — | 13.2 | 20.5 | 24.2 | 22.0 | 20.5 |

The results obtained indicate that the lubricating composition of the invention (e.g., a grease composition) is capable of providing acceptable wear performance, acceptable extreme pressure performance. In addition, the lubricating composition of the invention has improved grease consistency/penetration compared with a grease containing a solid potassium pentaborate tetrahydrate.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising: (a) an oil of lubricating viscosity; (b) an alkali metal borate dispersion comprising a crystalline alkali metal pentaborate, wherein the alkali metal borate has a mole ratio of alkali metal to boron of 1:3.5 to 1:10, and (c) a grease thickener.

2. The composition of claim 1, wherein the grease thickener is derived from a metal soap of a carboxylic acid and/or ester, wherein the metal of the metal soap is selected from the group consisting of alkali metal, alkaline earth metal, titanium, aluminum and mixtures thereof.

3. The composition of claim 1, wherein the carboxylic acid and/or ester is derived from a hydroxystearic acid.

4. The composition of claim 1, wherein the grease thickener is derived from an overbased calcium sulphonate.

5. The composition of claim 1, wherein the grease thickener consists of a polyurea or diurea comprised of reacting a diisocynate with fatty amine or polyamine and fatty amine.

6. The composition of claim 1, wherein the grease thickener consists of a non-soap based thickener selected from the group consisting of a silica, clay, other filler type, and mixtures thereof.

7. The lubricating composition of claim 6, wherein the physical processing results in the alkali metal borate having a mean particle size in a range of about 100 nanometers to about 1 μm.

8. The lubricating composition of claim 1, wherein the lubricating composition has a nephelometric turbidity unit in a range of about 500 to about 3500.

9. The lubricating composition of claim 1, wherein the alkali metal borate has a mole ratio of alkali metal to boron in a range of about 1:4 to about 1:8.

10. The lubricating composition of claim 1, wherein the alkali metal borate dispersion contains not more than one surfactant.

11. The lubricating composition of claim 10, wherein the surfactant is selected from the group consisting of a succinimide, a succinate, a C8-30-hydrocarbyl substituted sulphonate, and mixtures thereof.

12. The lubricating composition of claim 10, wherein the alkali metal borate dispersion comprises about 40 wt % to about 70 wt % of alkali metal borate, about 5 wt % to about 20 wt % of surfactant, and about 25 wt % to about 55 wt % of an oil of lubricating viscosity.

13. A method of lubricating a mechanical device comprising supplying to the mechanical device a lubricating composition comprising: (a) an oil of lubricating viscosity; (b) an alkali metal borate dispersion comprising a crystalline alkali metal pentaborate, wherein the alkali metal borate has a mole ratio of alkali metal to boron of 1:3.5 to 1:10, and (c) a grease thickener.

14. The method of claim 13, wherein the mechanical device require a grease.

* * * * *